US009768568B1

(12) United States Patent
Jin et al.

(10) Patent No.: US 9,768,568 B1
(45) Date of Patent: Sep. 19, 2017

(54) ELECTRICAL CONNECTOR

(71) Applicant: LOTES CO., LTD, Keelung (TW)

(72) Inventors: Zuo Feng Jin, Keelung (TW); Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/454,409

(22) Filed: Mar. 9, 2017

(30) Foreign Application Priority Data

Dec. 8, 2016 (CN) ..... 2016 2 1337533 U

(51) Int. Cl.
*H01R 24/00* (2011.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 24/60; H01R 4/02; H01R 13/6587; H01R 13/652; H01R 13/6471; H01R 2107/00
See application file for complete search history.

(56) References Cited

U.S. PATENT DOCUMENTS

| | | | | |
|---|---|---|---|---|
| 9,496,664 | B2 * | 11/2016 | Little | H01R 13/6587 |
| 9,647,369 | B2 * | 5/2017 | Tsai | H01R 4/02 |
| 2017/0047687 | A1 * | 2/2017 | Yao | H01R 13/6471 |
| 2017/0047689 | A1 * | 2/2017 | Yao | H01R 13/652 |
| 2017/0054258 | A1 * | 2/2017 | Little | H01R 24/60 |

* cited by examiner

*Primary Examiner* — Jean F Duverne
(74) *Attorney, Agent, or Firm* — Locke Lord LLP; Tim Tingkang Xia, Esq.

(57) ABSTRACT

An electrical connector for connecting a cable, includes an insulating body and a first terminal group received in the insulating body. The first terminal group includes a ground terminal, a power terminal, and first and second high-speed signal terminals. The first high-speed signal terminal has a first contacting portion, a first bending portion and a first soldering portion from front to rear. The extending direction of the first bending portion is different from that of the first contacting portion. The second high-speed signal terminal has a second contacting portion, a second bending portion, a reverse bending portion and a second soldering portion from front to rear. The second bending portion extends in a bending direction toward the first bending portion. The reverse bending portion reversely bends from the second bending portion. The spacing between the first and second soldering portions and the space for accommodating the cable are enlarged.

15 Claims, 7 Drawing Sheets

ELECTRICAL CONNECTOR

CROSS-REFERENCE TO RELATED APPLICATIONS

This non-provisional application claims priority to and benefit of, under 35 U.S.C. §119(a), Patent Application No. 201621337533.X filed in P.R. China on Dec. 8, 2016, the entire content of which is hereby incorporated by reference.

FIELD OF THE INVENTION

The present invention relates to an electrical connector, and more particularly to an electrical connector for being soldered to a cable.

BACKGROUND OF THE INVENTION

An existing plug connector includes an insulating body and multiple conducting terminals arranged in the insulating body. Each conducting terminal has a soldering portion soldered to a front end of a printed circuit board (PCB), and ends of wires of a cable are soldered to a rear end of the PCB in order to be correspondingly and electrically conducted with the conducting terminals. That is, the plug connector and the cable have to be connected through the PCB, and are not directly soldered to each other. As a result, problems, such as high production cost of the plug connector and complex manufacturing process, are caused. Furthermore, since both the conducting terminals and the wires have to be soldered to the PCB, there are a lot of soldered parts, the soldering quality of the product is harder to guarantee, and as a result, the production efficiency and the product quality of the plug connector are severely affected, which is not good for the increase of the market competitiveness of the product.

Aiming at the above-mentioned problems, those skilled in the art directly solder the wires to soldering portions of conducting terminals in one-to-one correspondence without using a PCB, so that the conducting terminals are directly and electrically conducted with a cable without requiring the PCB for adaption. However, because the cable needs to transmit high-speed signals and high current, the wires in the cable are thick, while the overall size of the electrical connector is small. As a result, the spacing between each two neighboring conducting terminals is limited. Consequently, the soldering space is insufficient, and it is hard to solder the plurality of conducting wires of the cable to the plurality of soldering portions in one-to-one correspondence.

Therefore, a heretofore unaddressed need exists in the art to address the aforementioned deficiencies and inadequacies.

SUMMARY OF THE INVENTION

In one aspect, the present invention relates to an electrical connector that enlarges the spacing between soldering portions of terminals and is convenient for being directly soldered to a cable.

In certain embodiments, an electrical connector is used for being electrically connected to a cable. The electrical connector includes an insulating body and a first terminal group received in the insulating body. The first terminal group includes at least one ground terminal, at least one power terminal, and at least one high-speed signal terminal pair located between the ground terminal and the power terminal. The high-speed signal terminal pair includes a first high-speed signal terminal and a second high-speed signal terminal. The first high-speed signal terminal is sequentially provided with a first contacting portion, a first bending portion and a first soldering portion from the front to the rear. The extending direction of the first bending portion is different from that of the first contacting portion. The first bending portion and the first soldering portion are located on the same plane. The second high-speed signal terminal is sequentially provided with a second contacting portion, a second bending portion, a reverse bending portion and a second soldering portion from the front to the rear. The second bending portion is formed by extending toward a bending direction close to the first bending portion. The reverse bending portion is formed by reversely bending from the second bending portion and is located on the same plane as the second bending portion. The first soldering portion and the second soldering portion are configured to be soldered to the cable.

In certain embodiments, a first connecting portion provided between the first contacting portion and the first bending portion is located on the same plane as the first bending portion, a second connecting portion provided between the second contacting portion and the second bending portion is located on the same plane as the second bending portion, and the spacing between the first contacting portion and the second contacting portion is larger than the spacing between the first connecting portion and the second connecting portion, and is smaller than the spacing between the first soldering portion and the second soldering portion.

In certain embodiments, the spacing between the first bending portion and the second bending portion is equal to the spacing between the first connecting portion and the second connecting portion.

In certain embodiments, an extending portion extends backward from the tail end of the first bending portion of the first high-speed signal terminal in a direction parallel to the first contacting portion, a turning portion bends and extends from the extending portion toward a direction away from the reverse bending portion, and the tail end of the turning portion extends backward along a direction parallel to the extending portion to form the first soldering portion.

In certain embodiments, the front end of the ground terminal is provided with a third contacting portion, the rear end is provided with a third soldering portion and a third bending portion located ahead of the third contacting portion and the third soldering portion. The front end of the power terminal is provided with a fourth contacting portion, the rear end is provided with a fourth soldering portion and a fourth bending portion located between the fourth contacting portion and the fourth soldering portion. Both the third bending portion and the fourth bending portion are in the same bending direction as the first bending portion. The third soldering portion and the fourth soldering portion are located in different planes and both are soldered to the cable.

In certain embodiments, the insulating body has a central line along a front-rear direction. The first terminal group is symmetrically arranged at the two opposite sides of the central line. The first terminal group also includes multiple low-speed signal terminals. Each low-speed signal terminal has a fifth contacting portion, a fifth soldering portion and a fifth bending portion located between the fifth contacting portion and the fifth soldering portion. The bending direction of each fifth bending portion is the same as that of the first bending portion located at the same side of the central line as the fifth bending portion.

In certain embodiments, both the first bending portion and the second bending portion bend along directions away from the central line, and the reverse bending portion bends along a direction close to the central line.

In certain embodiments, the first soldering portion, the second soldering portion, the fourth soldering portion and the fifth soldering portions are all flat, and are horizontally arranged in the same row in order to be soldered to the cable.

In certain embodiments, the spacing between the first soldering portion and the second soldering portion is larger than the spacing between two neighboring fifth soldering portions.

In certain embodiments, the low-speed signal terminals sequentially include a detecting terminal, a pair of universal serial bus (USB)2.0 terminals and a reserved terminal, there are two ground terminals, two power terminals and two high-speed signal terminal pairs symmetrically distributed relative to the central line, and the electrical connector is a USB TYPE C connector.

In certain embodiments, the electrical connector further includes a second terminal group, the front end of the insulating body is concavely provided with a insertion cavity, the first terminal group and the second terminal group are respectively located at the upper and lower sides of the insertion cavity in order to be arranged in an upper row and a lower row. Moreover, the first terminal group and the second terminal group are arranged in mutual point symmetry with the central point of the insertion cavity as a symmetry center. A latch member is arranged in the insulating body and is located between the first terminal group and the second terminal group, and both the ground terminals of the first terminal group and the ground terminals of the second terminal group are electrically conducted with the latch member.

In certain embodiments, a first metal shell sleeves the insulating body, one end of a second metal shell wraps the periphery of the first metal shell, the other end of the second metal shell wraps and fixes the cable. The second metal shell urges against any one of the ground terminals of the first terminal group, the ground terminals of the second terminal group and the latch member.

In certain embodiments, two sides of the latch member are provided with a pair of latch arms which enter into the insertion cavity. An elastic arm extends backward from each latch arm, and protrudes out of the insulating body. One side of each elastic arm is outwardly and convexly provided with a conducting portion, and the conducting portions urge against the inner wall surface of the second metal shell to form electrical conduction.

In certain embodiments, the first terminal group and an upper insulating block are injection-molded into a whole, and the second terminal group and a lower insulating block are injection-molded into a whole. The rear end of the insulating body is forwardly provided with an accommodating cavity, the upper insulating block and the lower insulating block are assembled into the accommodating cavity after being fit together, and forming a placement platform protruded out of the rear end of the accommodating cavity. The cable is located on the placement platform and is soldered to the first soldering portion and the second soldering portion.

In certain embodiments, the upper surface and the lower surface of the placement platform are respectively concavely provided with multiple wire arrangement slots for accommodating and fixing the cable along a vertical direction. The cable has at least one power wire. The rear end surface of the placement platform is recessed forward with at least one notch communicating with the wire arrangement slots along a front-rear direction. Both the power terminal of the first terminal group and the power terminal of the second terminal group are exposed in the notch. The power wire is retained in the notch in order to be soldered to the power terminal of the first terminal group and the power terminal of the second terminal group.

Compared with the related art, certain embodiments of the present invention have the following beneficial advantages:

The first high-speed signal terminal is provided with the first bending portion and the first contacting portion which are in different extending directions, the second high-speed signal terminal is provided with the second bending portion and the reverse bending portion, the bending direction of the second bending portion is the same as that of the first bending portion, the reverse bending portion is formed by reversely bending from the second bending portion, consequently, the spacing between the first soldering portion and the second soldering portion is enlarged, the space for accommodating the cable is enlarged, and thereby the soldering of the cable is facilitated. Moreover, the production cost of the electrical connector is reduced, and the manufacturing process is simplified. In addition, the arrangement of the reverse bending portion allows the adjustment of the length of the second high-speed signal terminal, so that the lengths of the second high-speed signal terminal and the first high-speed signal terminal can be kept equal, consequently, the affection of signal delay is decreased, and the high-frequency effect of the electrical connector is guaranteed.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
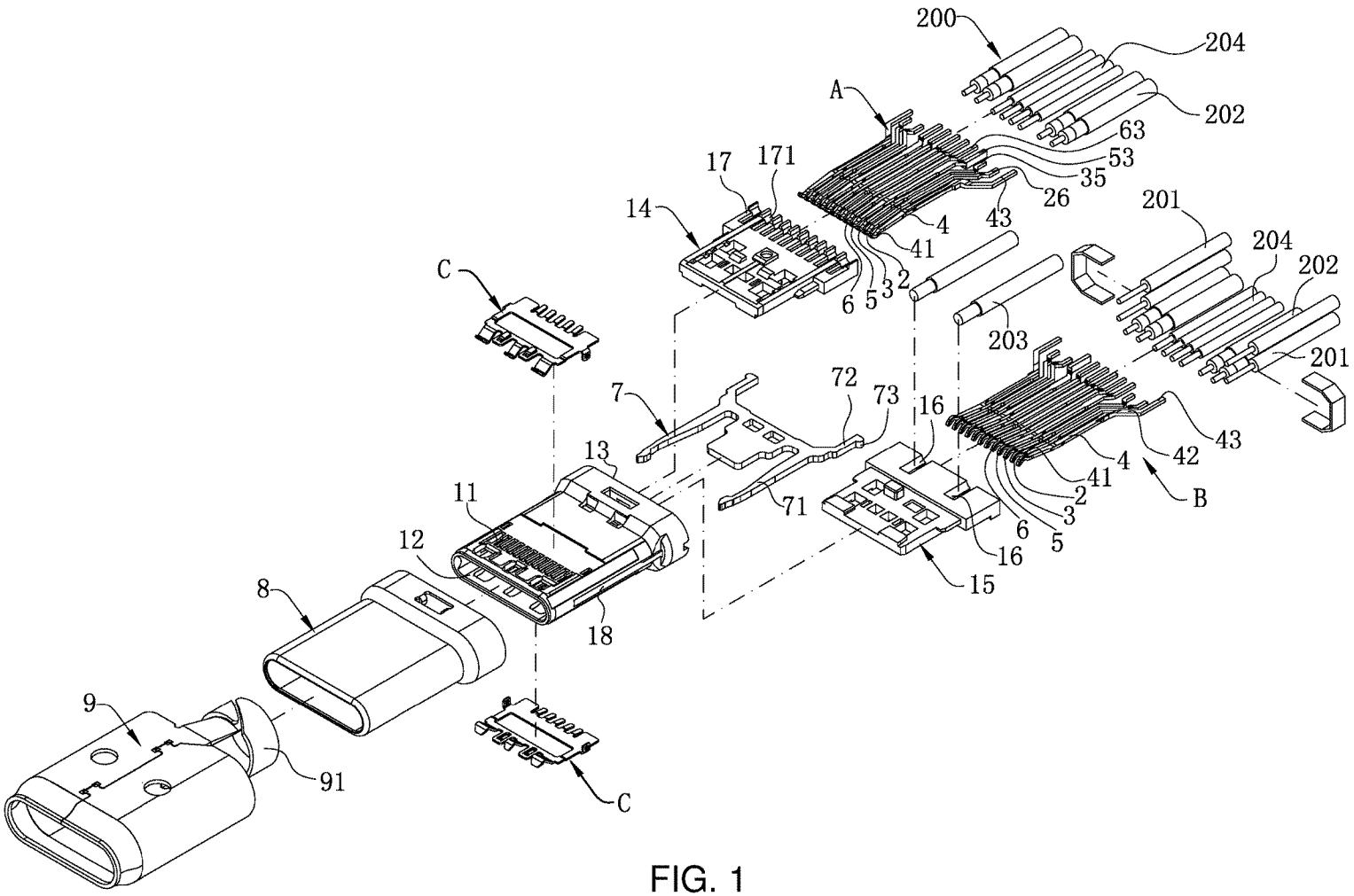
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 2:
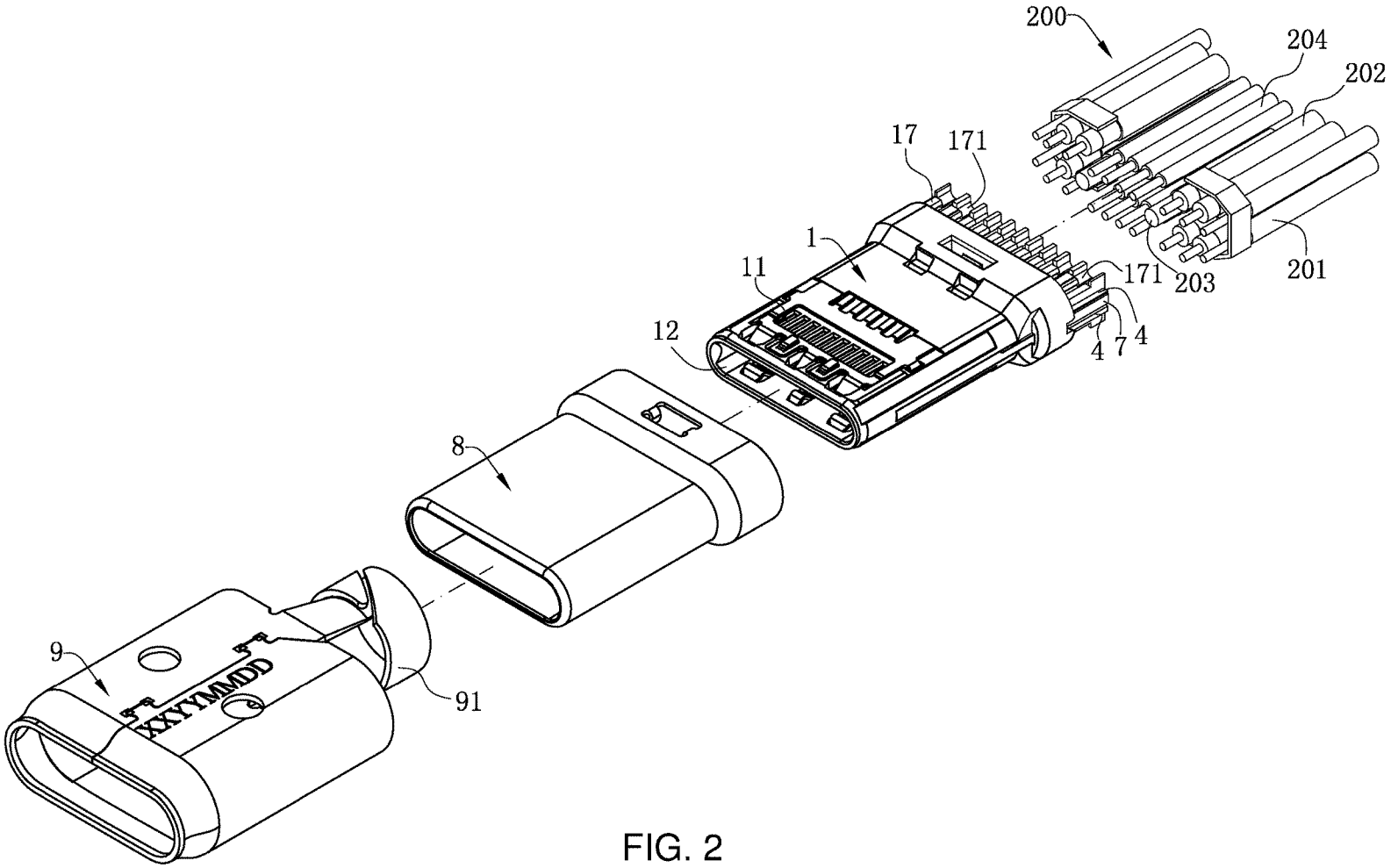
FIG. 2 is a local assembly view of an electrical connector according to one embodiment of the present invention before being soldered to a cable.

As shown in FIG. 1 and FIG. 2, an electrical connector 100 according to one embodiment of the present invention is an electrical connection plug supporting high-speed data transmission. The front end of the electrical connector 100 is provided with an insertion cavity 12 in which a receptacle connector (not shown) can be plugged therein. Further, the electrical connector 100 can be plugged into the corresponding receptacle connector in dual orientations, and the rear end of the electrical connector 100 is used to be electrically connected to a cable 200. The electrical connector 100 includes an insulating body 1. The rear end of the insulating body 1 is provided with a placement platform 17. A first terminal group A and a second terminal group B are received in the insulating body 1 and extend to the placement platform 17 in order to be soldered to the cable 200. A latch member 7 is disposed between the first terminal group A and the second terminal group B. A first metal shell 8 sleeves the insulating body 1. One end of a second metal shell 9 wraps the periphery of the first metal shell 8, and the other end of the metal shell 9 wraps and fixes the cable 200.

Figure 3:
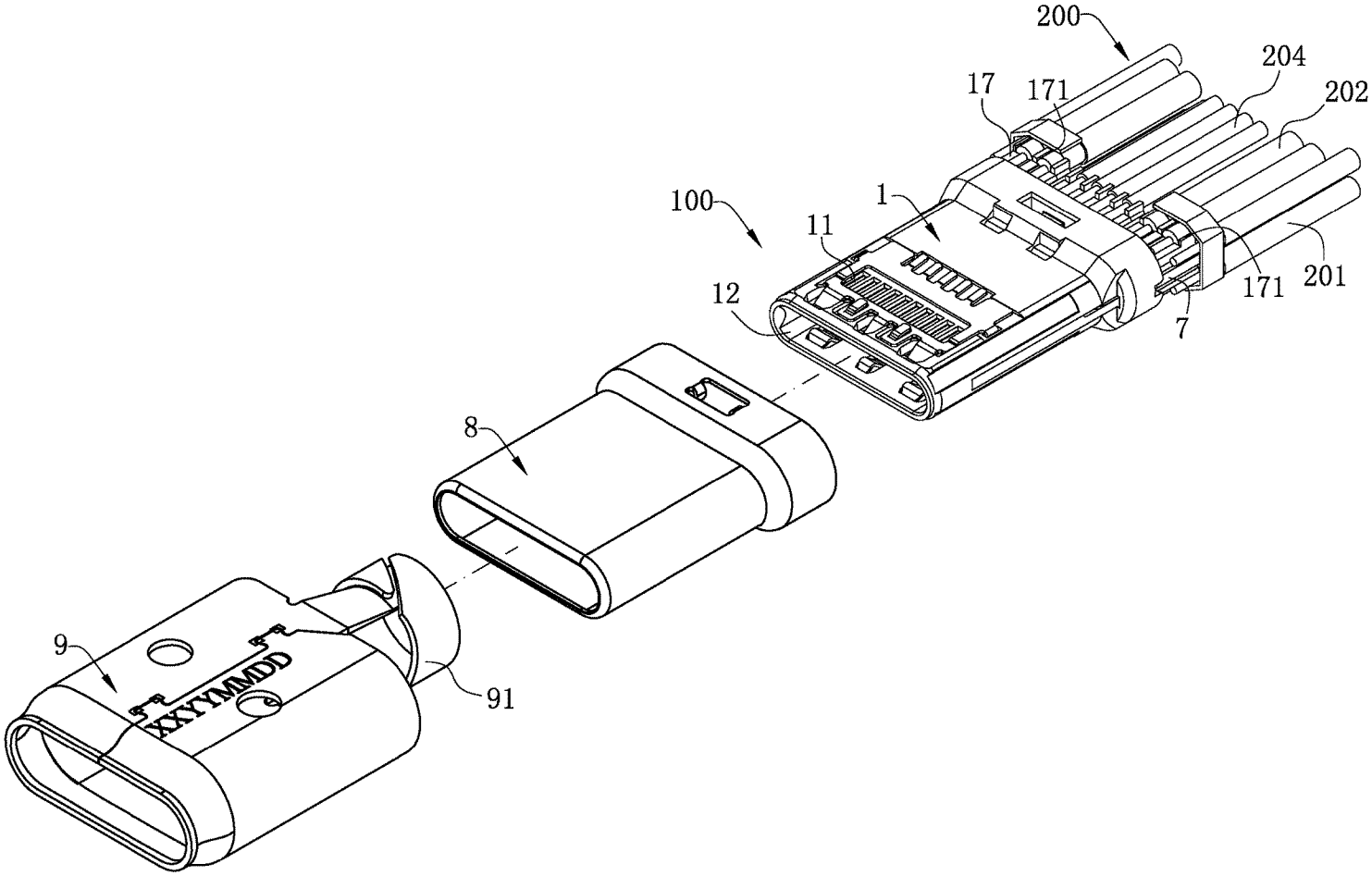
FIG. 3 is a local assembly view of an electrical connector according to one embodiment of the present invention after being soldered to the cable.

As shown in FIGS. 1-3, the front end of the insulating body 1 is recessed backward to form the insertion cavity 12. The insertion cavity 12 is configured to receive a mating tongue (not shown) of the corresponding receptacle connector. The upper and lower sides in the vertical direction of the insertion cavity 12 of the insulating body 1 are respectively provided with a plurality of terminal slots 11, and two sidewalls of the insulating body 1 are respectively concavely provided with a hollowed portion 18 which communicates with the insertion cavity 12. A pair of shielding sheets C is respectively installed on the upper and lower surfaces of the insulating body 1, and each shielding sheet is provided with a plurality of elastic pieces which extend into the insertion cavity 12. The rear end of the insulating body 1 is forwardly provided with an accommodating cavity 13, and the accommodating cavity 13 communicates with the terminal slots 11. The insulating body 1 has a central line along a front-rear direction. Both the first terminal group A and the second terminal group B are provided with a plurality of terminals that are symmetrically arranged at the two opposite sides of the central line.

Figure 7:
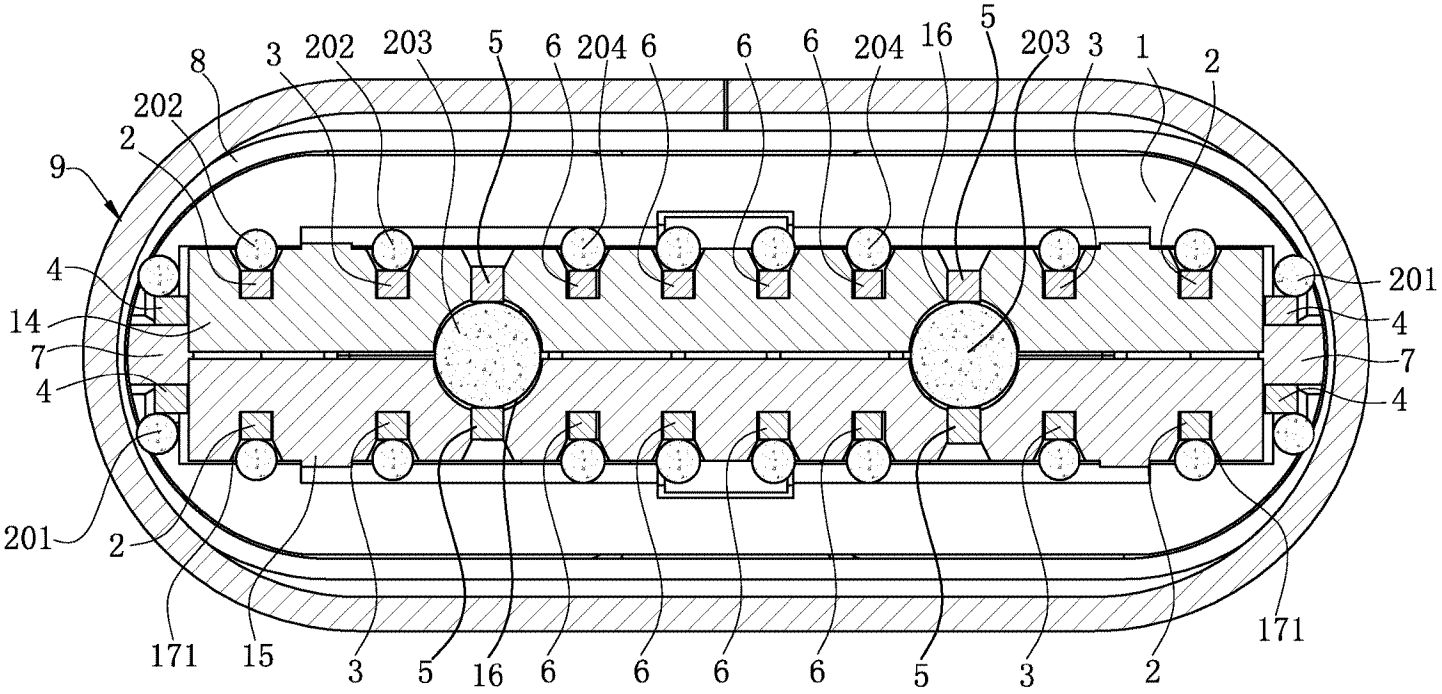
FIG. 7 is a sectional view of the electrical connector according to one embodiment of the present invention from another view angle.

As shown in FIGS. 1, 2 and 7, an upper terminal module (not labeled) and a lower terminal module (not labeled) are arranged in the insulating body 1. The upper terminal module includes an upper insulating block 14 and the first terminal group A integrally fixed in the upper insulating block 14 by injection molding. The lower terminal module includes a lower insulating block 15 and the second terminal group B integrally fixed in the upper insulating block 15 by injection molding. The lower insulating block 15 is provided with a fixing post (not labeled) which is contained and fixed in a fixing hole (not labeled) arranged in the upper insulating block 14. The upper insulating block 14 and the lower insulating block 15 are assembled into the insulating body 1 from the rear to the front after being assembled together. The front ends of both the first terminal group A and the second terminal group B correspondingly enter into the terminal slots 11 and partially extend into the insertion cavity 12 in order to be electrically connected to the receptacle connector. The front ends of the upper insulating block 14 and the lower insulating block 15 are fixed in the accommodating cavity 13, the rear ends of the upper insulating block 14 and the lower insulating block 15 jointly form the placement platform 17, and the placement platform 17 protrudes out of the accommodating cavity 13 for the placement of the cable 200. The upper surface and the lower surface of the placement platform 17 are each recessed with a plurality of wire arrangement slots 171 for fixing a plurality of conducting wires in the cable 200 along a vertical direction. The rear end surface of the placement platform 17 is recessed forward with at least one notch 16 communicating with the wire arrangement slots 171 along the front-rear direction. In the present embodiment, the placement platform 17 is provided with two notches 16, and the two notches 16 respectively run through the upper insulating block 14 and the lower insulating block 15 along the vertical direction.

As shown in FIGS. 1, 2 and 7, the front ends of the first terminal group A and the second terminal group B are located respectively at the upper and lower sides of the insertion cavity 12 in order to be arranged in an upper row and a lower row. Further, the first terminal group A and the second terminal group B are arranged in mutual point symmetry with the central point of the insertion cavity 12 as a symmetry center. That is, the number of terminals of the first terminal group A is equal to the number of terminals of the second terminal group B, and a terminal arrangement sequence is distributed in diagonal symmetry, so that the receptacle connector can be plugged in dual orientation. The rear ends of the first terminal group A are located on the upper surface of the placement platform 17 in order to be soldered to the cable 200, and the rear ends of the second terminal group B are located on the lower surface of the placement platform 17 in order to be soldered to the cable 200. The second terminal group B has the same structure as the first terminal group A, so only the first terminal group A of the present embodiment is described in detail as follows. The first terminal group A includes at least one ground terminal 4, at least one power terminal 5 and at least one high-speed signal terminal pair located between the ground terminal 4 and the power terminal 5. The high-speed signal terminal pair includes a first high-speed signal terminal 2 and a second high-speed signal terminal 3. In the present embodiment, the electrical connector 100 is a USB TYPE C connector, and there are two ground terminals 4, two power terminals 5 and two high-speed signal terminal pairs. The first terminal group A further includes a plurality of low-speed signal terminals 6. The plurality of low-speed signal terminals 6 sequentially includes a detecting terminal, a pair of USB2.0 terminals and a reserved terminal. The arrangement sequence of the first terminal group A arranged on the placement platform 17 is: a ground terminal (GND), a first high-speed signal terminal (SSTXp1), a second high-speed signal terminal (SSTXn1), a power terminal (Vbus), a detecting terminal (CC), a USB2.0 terminal pair (D+, D−), a reserved terminal (Vconn), a power terminal (Vbus), a second high-speed signal terminal (SSTXn1), a first high-speed signal terminal (SSTXp1) and a ground terminal (GND). The cable 200 is provided with two rows of conducting wires. The arrangement sequence of each row of conducting wires arranged on the placement platform 17 is: a grounding wire 201, two high-speed signal wires 202, a power wire 203, four low-speed signal wires 204, a power wire 203, two high-speed signal wires 202, and a grounding wire 201. Further, the diameter of the high-speed signal wire 202 is greater than that of the grounding wire 201 and the low-speed signal wire 204. In the present embodiment, the electrical connector 100 is a USB TYPE C connector. In other embodiments, the electrical connector 100 can also be connectors of the input/output (IO) class with other specifications. The number of each of the ground terminal 4, the power terminal 5 and the high-speed signal terminal pair of the first terminal group A can be one or more, and the plurality of conducting wires of the cable 200 are in one-to-one correspondence to the first terminal group A and the second terminal group B.

Figure 4:
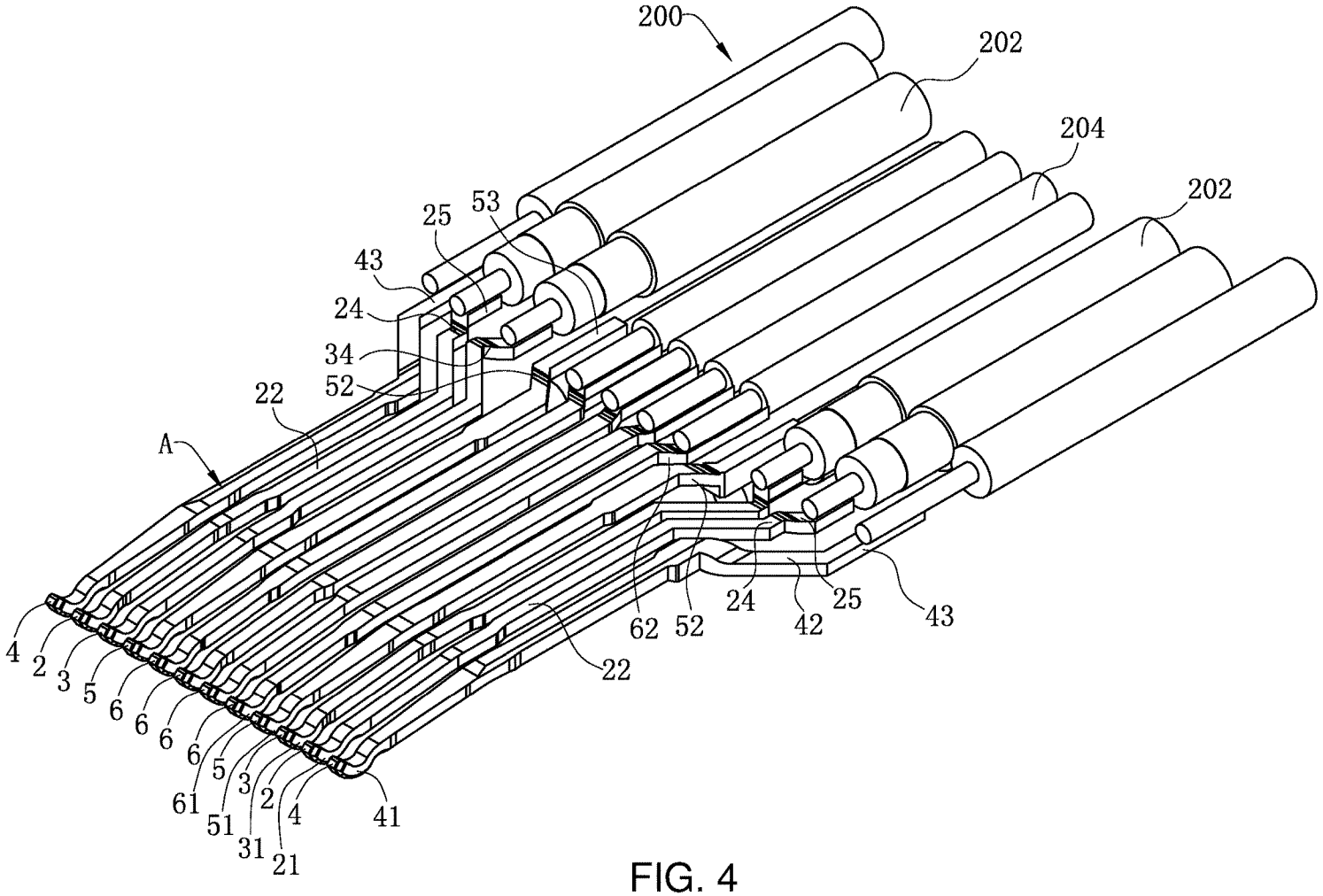
FIG. 4 is a schematic view of a first terminal group of an electrical connector according to one embodiment of the present invention after being soldered to a cable.
Figure 5:
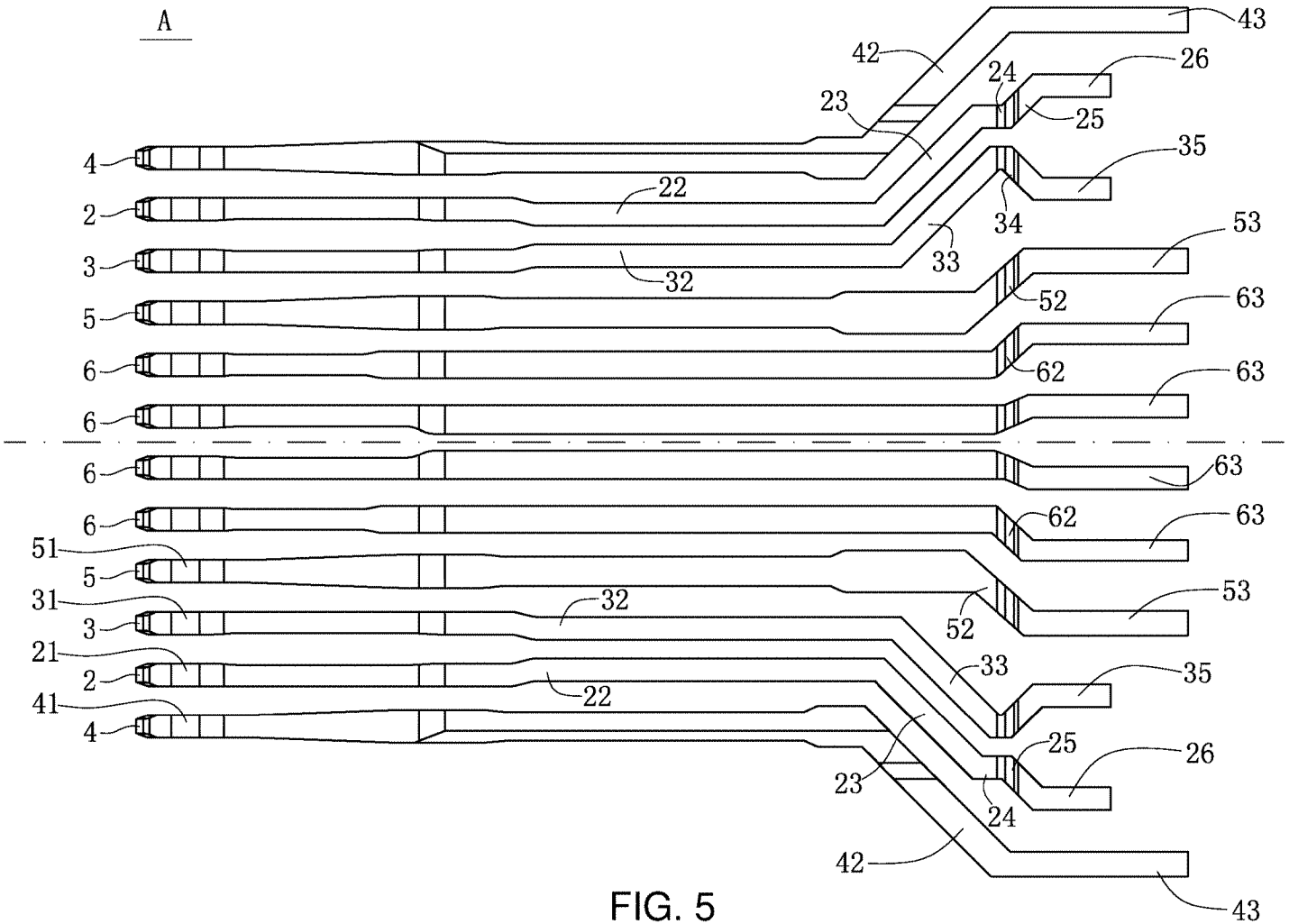
FIG. 5 is an arrangement diagram of a first terminal group of an electrical connector according to one embodiment of the present invention.

As shown in FIGS. 4, 5 and 7, each first high-speed signal terminal 2 is sequentially provided with a first contacting portion 21, a first bending portion 23 and a first soldering portion 26 from the front to the rear. The first contacting portion 21 is received in the corresponding terminal slot 11 and protrudes into the insertion cavity 12. The first bending portion 23 is fixed in the upper insulating block 14. The first soldering portion 26 is correspondingly located on the placement platform 17 in order to be soldered to the corresponding high-speed signal wire 202. The extending direction of the first bending portion 23 is different from that of the first contacting portion 21. The first bending portion 23 is formed by horizontally bending by an angle from the first contacting portion 21. Both the first bending portion 23 and the first soldering portion 26 are located on the same plane, and the first soldering portion 26 is parallel to the first contacting portion 21. In the present embodiment, a first connecting portion 22 provided between the first contacting portion 21 and the first bending portion 23 is located on the same plane as the first bending portion 23. The first connecting portion 22 is formed by horizontally bending from the first contacting portion 21. The bending direction of the first connecting portion 22 is opposite to the bending direction of the first bending portion 23. An extending portion 24 extends backward from the tail end of the first bending portion 23 of the first high-speed signal terminal 2 along a direction parallel to the first contacting portion 21, a turning portion 25 bends and extends from the extending portion 24 along the bending direction of the first bending portion 23, the tail end of the turning portion 25 extends backward along a direction parallel to the extending portion 24 to form the first soldering portion 26, and both the turning portion 25 and the extending portion 24 are coplanar with the first soldering portion 26. In the other embodiments, each first high-speed signal terminal 2 can also be not provided with the first connecting portion 22, the extending portion 24 and the turning portion 25, as long as it is ensured that the lengths of the first high-speed signal terminal 2 and the second high-speed signal terminal 3 are equal.

As shown in FIGS. 4, 5 and 7, each second high-speed signal terminal 3 is sequentially provided with a second contacting portion 31, a second bending portion 33, a reverse bending portion 34 and a second soldering portion 35 from the front to the rear. The second contacting portion 31 is received in the terminal slot 11 and protrudes into the insertion cavity 12. The second bending portion 33 and the reverse bending portion 34 are located on the same plane and are both fixed in the upper insulating block 14. The second soldering portion 35 and the first soldering portion 26 are located side by side on the placement platform 17 in order to be soldered to the High-speed signal wire 202. The second bending portion 33 is formed by extending toward a bending direction close to the first bending portion 23. That is, the bending direction of the second bending portion 33 is the same as that of the first bending portion 23. The reverse bending portion 34 is formed by reversely bending from the second bending portion 33, and the bending direction of the reverse bending portion 34 is opposite to that of the turning portion 25. The first soldering portion 26 and the second soldering portion 35 are parallel to each other, and are located on the same plane. Since the reverse bending portion 34 is formed by reversely bending from the second bending portion 33, the spacing between the first soldering portion 26 and the second soldering portion 35 is enlarged, the space for accommodating the cable 200 is enlarged, and thereby the soldering of the cable 200 is facilitated. Moreover, the production cost of the electrical connector 100 is reduced, and the manufacturing process is simplified. In addition, the arrangement of the reverse bending portion 34 allows the adjustment of the length of the second high-speed signal terminal 3, so that the lengths of the second high-speed signal terminal 3 and the first high-speed signal terminal 2 can be kept equal, consequently, the affection of signal delay is decreased, and the high-frequency effect of the electrical connector 100 is guaranteed.

As shown in FIGS. 4, 5 and 7, in the present embodiment, a second connecting portion 32 is provided between the second contacting portion 31 and the second bending portion 33, and the spacing between the first contacting portion 21 and the second contacting portion 31 is larger than the spacing between the first connecting portion 22 and the second connecting portion 32, and is smaller than the spacing between the first soldering portion 26 and the second soldering portion 35. That is, the spacing between the first soldering portion 26 and the second soldering portion 35 is largest, providing an enough accommodating space for the cable 200. The spacing between the first bending portion 23 and the second bending portion 33 and the spacing between the first connecting portion 22 and the second connecting portion 32 are equal and both smaller than the spacing between the first contacting portion 21 and the second contacting portion 31, so that the first high-speed signal terminal 2 is close to the second high-speed signal terminal 3 as much as possible in order to guarantee the transmission of high-frequency signals.

As shown in FIGS. 4, 5 and 7, in the present embodiment, both the first bending portion 23 and the second bending portion 33 bend along directions away from the central line, and the reverse bending portion 34 bends along a direction toward the central line. In other embodiments, both the first bending portion 23 and the second bending portion 33 bend along directions toward the central line and the reverse bending portion 34 bends along a direction away from the central line, as long as the spacing between the first soldering portion 26 and the second soldering portion 35 can be enlarged.

As shown in FIGS. 4, 5 and 7, the ground terminals 4 are located at the outer sides of the first high-speed signal terminals 2, and are configured to shield signal interference at the outer sides of the first high-speed signal terminals 2. The front end of each ground terminal 4 is provided with a third contacting portion 41, the rear end is provided with a third soldering portion 43 and a third bending portion 42 located between the third contacting portion 41 and the third soldering portion 43. The bending direction of the third bending portion 42 is the same as that of the first bending portion 23. The arrangement of the third bending portion 42 enlarges the spacing between the third soldering portion 43 and the first soldering portion 26, reserving space for the soldering of the high-speed signal wire 202. The third soldering portion 43 is projected outside the placement platform 17 to be soldered to the grounding wire 201. Consequently, not only can the grounding wire 201 be conveniently soldered to the third soldering portion 43, but also the space of the placement platform 17 is saved, so that the other conducting wires can be placed conveniently.

As shown in FIGS. 4, 5 and 7, the front end of each power terminal 5 is provided with a fourth contacting portion 51 that is correspondingly received in the terminal slot 11 and protrudes into the insertion space, and the rear end is provided with a fourth soldering portion 53 that is located over the notch 16. The power wires 203 are located in the notches 16 and are soldered to the fourth soldering portions 53 by solder. The notches 16 are located between the power terminals 5 of the first terminal group A and the power terminals 5 of the second terminal group B. The upper and lower surfaces of the power wires 203 are respectively soldered to the power terminals 5 of the first terminal group A and the power terminals 5 of the second terminal group B by solder. Since the power wires 203 are arranged in the notches 16, not only is the space of the placement platform 17 saved, reserving space for the soldering of the high-speed signal wires 202, so that the high-speed signal wires 202 can be easily soldered to the second soldering portions 35, but also the number of the power wires 203 is reduced, and thereby the production cost is reduced. Each power terminal 5 is provided with a fourth bending portion 52 between the fourth contacting portion 51 and the fourth soldering portion 53, and the bending direction of the fourth bending portion 52 is the same as that of the first bending portion 23.

As shown in FIGS. 4, 5 and 7, each low-speed signal terminal 6 is provided with a fifth contacting portion 61, a fifth soldering portion 63 and a fifth bending portion 62 located between the fifth contacting portion 61 and the fifth soldering portion 63. The bending direction of each fifth bending portion 62 is the same as that of the first bending portion 23 located at the same side of the central line as the fifth bending portion 62. The fifth contacting portions 61 are correspondingly received in the terminal slots 11 and extend into the insertion cavity 12 in order to be inserted into the receptacle connector. The fifth soldering portions 63 are all arranged on the placement platform 17 in order to be soldered to the low-speed signal wires 204. The spacing between each two neighboring fifth soldering portions 63 is smaller than the spacing between the first soldering portion 26 and the second soldering portion 35. Since the diameter of the low-speed signal wires 204 is smaller than that of the high-speed signal wire 202, the space occupied by the low-speed signal wires 204 is small, and thereby soldering is easy. The first soldering portion 26, the second soldering portion 35, the third soldering portion 43, the fourth soldering portion 53 and the fifth soldering portions 63 are all flat, and are horizontally arranged in the same row on the placement platform 17.

As shown in FIGS. 1, 2, 6 and 7, the latch member 7 is arranged in the insulating body 1 and is located between the first terminal group A and the second terminal group B. The latch member 7 is inserted into the insulating body 1 from the rear to the front. In the vertical direction, the latch member 7 is clamped by the upper terminal module and the lower terminal module and is located therebetween. Two sides of the latch member 7 are provided with a pair of latch arms 71 which are received in the hollowed portion 18 and extend into the insertion cavity 12. An elastic arm 72 bends and extends backward from each latch arm 71, and protrudes out of the accommodating cavity 13. Both the ground terminals 4 of the first terminal group A and the ground terminals 4 of the second terminal group B are in contact with the elastic arms 72 to form electrical conduction. The second metal shell 9 urges against at least one of the ground terminals 4 of the first terminal group A, the ground terminals 4 of the second terminal group B and the latch member 7. In the present embodiment, the second metal shell 9 urges against the latch member 7. One side of each elastic arm 72 of the latch member 7 is outwardly and convexly provided with a conducting portion 73. The conducting portions 73 urge against the inner wall surface of the second metal shell 9 to form electrical conduction, and thereby the ground terminals 4 and the latch member 7 are electrically connected to the second metal shell 9 to achieve a grounding effect in order to decrease resonance in the process of signal transmission, guaranteeing the transmission stability of high-frequency signals of the electrical connector 100.

Figure 6:
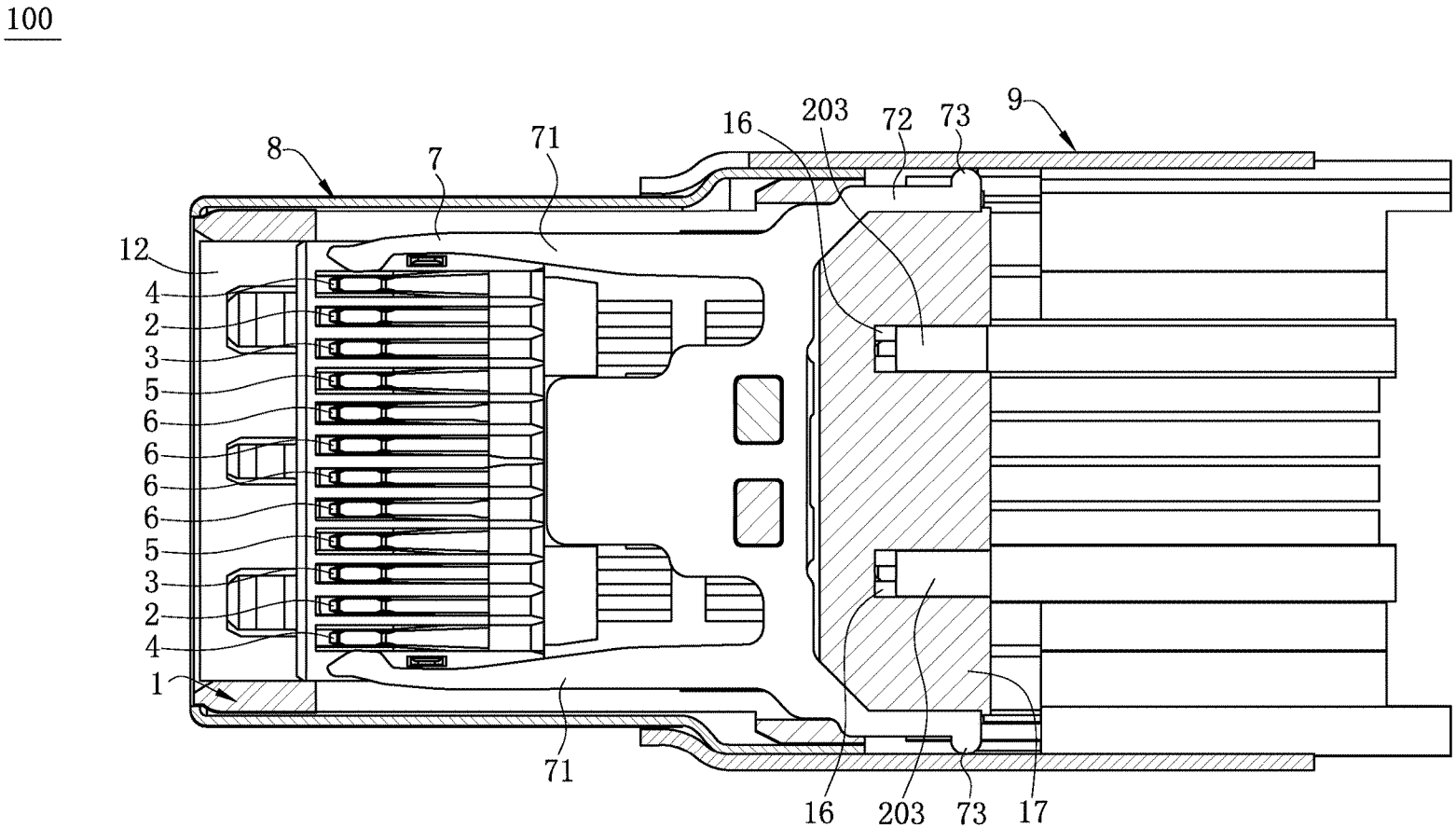
FIG. 6 is a sectional view of an electrical connector according to one embodiment of the present invention.

As shown in FIGS. 1, 2 and 6, the first metal shell 8 is cylindrical. The first metal shell 8 sleeves the periphery of the insulating body 1 from the front to the rear. The top surface and the bottom surface of the first metal shell 8 are each provided with a retaining sheet (not labeled) retained to the insulating body 1. The placement platform 17 protrudes out of the first metal shell 8. That is, both the wire arrangement slots 171 of the upper insulating block 14 and the wire arrangement slots 171 of the lower insulating block 15 protrude out of the first metal shell 8.

As shown in FIGS. 1, 2 and 6, the front end of the second metal shell 9 wraps the rear end of the first metal shell 8. The wire arrangement slots 171 are located in the second metal shell 9, the elastic arms 72 are located in the second metal shell 9, and the conducting portions 73 urge against the second metal shell 9 to form a ground loop. The rear end of the second metal shell 9 is provided with a cable-wrapping portion 91 which wraps the periphery of the cable 200, and thereby the electrical connector 100 and the cable 200 are fixed together. An insulating shell (not shown) is injection-molded on the second metal shell 9, and integrally wraps the cable 200, and thereby the complete electrical connector 100 connected with the cable 200 is formed.

As shown in FIGS. 3, 4 and 7, when the electrical connector 100 is soldered to the cable 200, the first soldering portions 26, the second soldering portions 35 and the fifth soldering portions 63 of the first terminal group A are all arranged on the upper surface of the placement platform 17, and the first soldering portions 26, the second soldering portions 35 and the fifth soldering portions 63 of the second terminal group B are all arranged on the lower surface of the placement platform 17. The cable 200 is provided with the two rows of conducting wires which are respectively located on the upper surface and the lower surface of the placement platform 17 in order to be correspondingly soldered to the first terminal group A and the second terminal group B. Taking the first terminal group A as an example, the grounding wires 201 of the upper row are located at the outer side of the placement platform 17 and are soldered to the third soldering portions 43, the high-speed signal wires 202 of the upper row are correspondingly fixed in the wire arrangement slots 171 of the upper surface of the placement platform 17 in order to be soldered to the first soldering portions 26 and the second soldering portions 35, the power wires 203 are inserted into the notches 16 and are soldered to the fourth soldering portions 53, the low-speed signal wires 204 are correspondingly fixed in the wire arrangement slots 171 of the upper surface of the placement platform 17 and are soldered to the fifth soldering portions 63, and thereby the electrical connection between the electrical connector 100 and the cable 200 is completed. The second terminal group B has the same structure as the first terminal group A, the conducting wires of the lower row of the cable 200 have the same structure as the conducting wires of the upper row, and therefore there is no need to repeat any more.

In summary, the electrical connector 100 according to certain embodiments of the present invention has the following beneficial advantages:

(1) The first high-speed signal terminal 2 is provided with the first bending portion 23 and the first contacting portion 21 which are in different extending directions. The second high-speed signal terminal 3 is provided with the second bending portion 33 and the reverse bending portion 34. The bending direction of the second bending portion 33 is the same as that of the first bending portion 23. The reverse bending portion 34 is formed by reversely bending from the second bending portion 33. Consequently, the spacing between the first soldering portion 26 and the second soldering portion 35 is enlarged, the space for accommodating the cable 200 is enlarged, and thereby the soldering of the cable 200 is facilitated. Moreover, the production cost of the electrical connector 100 is reduced, and the manufacturing process is simplified. In addition, the arrangement of the reverse bending portion 34 allows the adjustment of the length of the second high-speed signal terminal 3, so that the lengths of the second high-speed signal terminal 3 and the first high-speed signal terminal 2 can be kept equal. Consequently, the effect of signal delay is decreased, and the high-frequency effect of the electrical connector 100 is guaranteed.

(2) The spacing between the first contacting portion 21 and the second contacting portion 31 is larger than the spacing between the first connecting portion 22 and the second connecting portion 32, and is smaller than the spacing between the first soldering portion 26 and the second soldering portion 35. That is, the spacing between the first soldering portion 26 and the second soldering portion 35 is largest, providing an enough accommodating space for the cable 200.

(3) The spacing between the first bending portion 23 and the second bending portion 33 and the spacing between the first connecting portion 22 and the second connecting portion 32 are equal and both smaller than the spacing between the first contacting portion 21 and the second contacting portion 31, so that the first high-speed signal terminal 2 is close to the second high-speed signal terminal 3 as much as possible in order to guarantee the transmission of high-frequency signals.

(4) The bending direction of the third bending portion 42 of the ground terminal 4 is the same as that of the first bending portion 23, and the arrangement of the third bending portion 42 enlarges the spacing between the third soldering portion 43 and the first soldering portion 26, reserving space for the soldering of the high-speed signal wire 202. The third soldering portion 43 is projected outside the placement platform 17 in order to be soldered to the grounding wire 201, and consequently, not only can the grounding wire 201 be conveniently soldered to the third soldering portion 43, but also the space of the placement platform 17 is saved, so that the other conducting wires can be placed conveniently.

(5) The power wires 203 are located in the notches 16 and are soldered to the fourth soldering portions 53. The notches 16 are located between the power terminals 5 of the first terminal group A and the power terminals 5 of the second terminal group B. The upper and lower surfaces of the power wires 203 are respectively soldered to the power terminals 5 of the first terminal group A and the power terminals 5 of the second terminal group B by solder. Since the power wires 203 are arranged in the notches 16, not only is the space of the placement platform 17 saved, reserving space for the soldering of the high-speed signal wires 202, so that the high-speed signal wires 202 can be easily soldered to the second soldering portions 35, but also the number of the power wires 203 is reduced, and thereby the production cost is reduced.

(6) Both the ground terminals 4 of the first terminal group A and the ground terminals 4 of the second terminal group B are in contact with the elastic arms 72 to form electrical conduction. One side of each elastic arm 72 is outwardly and concavely provided with the conducting portion 73 which urges against the inner wall surface of the second metal shell 9 to form electrical conduction, and thereby the ground terminals 4 and the latch member 7 are electrically connected to the second metal shell 9 to achieve a grounding effect, so that resonance in the process of signal transmission is decreased, guaranteeing the transmission stability of high-frequency signals of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting a cable, comprising:

an insulating body, and a first terminal group received in the insulating body, and comprising at least one ground terminal, at least one power terminal and at least one high-speed signal terminal pair located between the at least one ground terminal and the at least one power terminal, wherein the high-speed signal terminal pair comprises a first high-speed signal terminal and a second high-speed signal terminal, the first high-speed signal terminal has sequentially a first contacting portion, a first bending portion and a first soldering portion from front to rear, an extending direction of the first bending portion is different from that of the first contacting portion, the first bending portion and the first soldering portion are located on a same plane, the second high-speed signal terminal has sequentially a second contacting portion, a second bending portion, a reverse bending portion and a second soldering portion from front to rear, the second bending portion bends toward and extends a bending direction of the first bending portion, the reverse bending portion reversely bends from the second bending portion and is located on a same plane as the second bending portion, and the first soldering portion and the second soldering portion are configured to be soldered to the cable.

2. The electrical connector of claim 1, wherein the first high-speed signal terminal further comprises a first connecting portion disposed between the first contacting portion and the first bending portion and located on the same plane as the first bending portion;

wherein the second high-speed signal terminal comprises a second connecting portion disposed between the second contacting portion and the second bending portion and located on the same plane as the second bending portion; and wherein a spacing between the first contacting portion and the second contacting portion is larger than a spacing between the first connecting portion and the second connecting portion, and is smaller than a spacing between the first soldering portion and the second soldering portion.

3. The electrical connector of claim 2, wherein a spacing between the first bending portion and the second bending portion is equal to the spacing between the first connecting portion and the second connecting portion.

4. The electrical connector of claim 1, wherein the first high-speed signal terminal further comprises:

an extending portion extending backward from a tail end of the first bending portion in a direction parallel to the first contacting portion; and a turning portion bending and extending from the extending portion toward a direction away from the reverse bending portion, wherein a tail end of the turning portion extends backward along a direction parallel to the extending portion to form the first soldering portion.

5. The electrical connector of claim 1, wherein the at least one ground terminal has a third contacting portion located at a front end thereof, a third soldering portion located at a rear end thereof, and a third bending portion located between the third contacting portion and the third soldering portion;

wherein the at least one power terminal has a fourth contacting portion located at a front end thereof, a fourth soldering portion located at a rear end thereof, and a fourth bending portion located between the fourth contacting portion and the fourth soldering portion; and wherein bending directions of both the third bending portion and the fourth bending portion are the same as a bending direction of the first bending portion, and the third soldering portion and the fourth soldering portion are located in different planes and both are soldered to the cable.

6. The electrical connector of claim 5, wherein the insulating body has a central line along a front-rear direction, the first terminal group is symmetrically arranged at two opposite sides of the central line, the first terminal group further comprises a plurality of low-speed signal terminals, each of the low-speed signal terminals has a fifth contacting portion, a fifth soldering portion and a fifth bending portion located between the fifth contacting portion and the fifth soldering portion, and a bending direction of each fifth bending portion is the same as that of the first bending portion located at a same side of the central line as the fifth bending portion.

7. The electrical connector of claim 6, wherein both the first bending portion and the second bending portion bend along directions away from the central line, and the reverse bending portion bends along a direction toward the central line.

8. The electrical connector of claim 6, wherein the first soldering portion, the second soldering portion, the fourth soldering portion and the fifth soldering portions are all flat, and are horizontally arranged in a same row for being soldered to the cable.

9. The electrical connector of claim 6, wherein a spacing between the first soldering portion and the second soldering portion is larger than a spacing between two neighboring fifth soldering portions.

10. The electrical connector of claim 6, wherein the plurality of low-speed signal terminals sequentially comprises a detecting terminal, a pair of universal serial bus (USB)2.0 terminals and a reserved terminal, there are two ground terminals, two power terminals and two high-speed signal terminal pairs symmetrically distributed relative to the central line, and the electrical connector is a USB TYPE C connector.

11. The electrical connector of claim 1, further comprising a second terminal group, wherein the second terminal group comprises at least one ground terminal, a front end of the insulating body is recessed with an insertion cavity, the first terminal group and the second terminal group are located respectively at upper and lower sides of the insertion cavity in order to be arranged in an upper row and a lower row, the first terminal group and the second terminal group are arranged in mutual point symmetry with a central point of the insertion cavity as a symmetry center, a latch member is arranged in the insulating body and is located between the first terminal group and the second terminal group, and both the at least one ground terminal of the first terminal group and the at least one ground terminal of the second terminal group are conducted electrically with the latch member.

12. The electrical connector of claim 11, further comprising:

a first metal shell sleeved on the insulating body; and a second metal shell having one end wrapping a periphery of the first metal shell, and the other end wrapping and fixing the cable, wherein the second metal shell urges against at least one of the at least one ground terminal of the first terminal group, the at least one ground terminal of the second terminal group and the latch member.

13. The electrical connector of claim 12, wherein the latch member has a pair of latch arms disposed at two sides thereof and entering the insertion cavity, an elastic arm extends backward from each of the latch arms and protrudes out of the insulating body, one side of each of the elastic arms is outwardly and convexly provided with a conducting portion, and the conducting portions urge against an inner wall surface of the second metal shell to form electrical conduction.

14. The electrical connector of claim 11, wherein the first terminal group and an upper insulating block are injection-molded into a whole, the second terminal group and a lower insulating block are injection-molded into a whole, a rear end of the insulating body is forwardly provided with an accommodating cavity, the upper insulating block and the lower insulating block are installed into the accommodating cavity after being assembled together and form a placement platform protruding out of a rear end of the accommodating cavity, and the cable is located on the placement platform and is soldered to the first soldering portion and the second soldering portion.

15. The electrical connector of claim 14, wherein upper and lower surfaces of the placement platform are respectively recessed along a vertical direction with a plurality of wire arrangement slots for retaining the cable, the cable comprises at least one power wire, a rear surface of the placement platform is recessed with at least one notch along a front-rear direction and in communication with the wire arrangement slots, both the at least one power terminal of the first terminal group and the at least one power terminal of the second terminal group are exposed in the notch, and the power wire is received in the notch for being soldered to the at least one power terminal of the first terminal group and the at least one power terminal of the second terminal group.

* * * * *